US005454437A

United States Patent [19]

Estes

[11] Patent Number: 5,454,437

[45] Date of Patent: Oct. 3, 1995

[54] ROLLER CONE CORE BIT

[75] Inventor: Roy D. Estes, Weatherford, Tex.

[73] Assignee: Rock Bit International, Inc., Fort Worth, Tex.

[21] Appl. No.: 82,238

[22] Filed: Jun. 24, 1993

[51] Int. Cl.[6] ..... E21B 10/16

[52] U.S. Cl. ..... 175/332; 175/376; 175/403

[58] Field of Search ..... 175/403, 398, 175/401, 376, 332, 333, 341, 343

[56] References Cited

U.S. PATENT DOCUMENTS

| | | | |
|---|---|---|---|
| 1,978,085 | 10/1934 | Howard et al. | 175/332 |
| 2,030,298 | 2/1936 | Howard et al. | 175/332 |
| 4,763,736 | 8/1988 | Varel, Sr. | 175/341 |

OTHER PUBLICATIONS

Globe Oil Tools Catalog No. 41.

Security six-cone hole opener (date unknown).

Prior art core bit having two inboard facing and two outboard facing cones. (date unknown).

Prior art core bit having four inboard facing cone cutters. (date unknown).

*Primary Examiner*—Terry Lee Melius

*Attorney, Agent, or Firm*—Arnold, White & Durkee

[57] ABSTRACT

The present invention relates to an improved roller cone core bit comprising a plurality of cone cutters facing inboard and a single cone cutter facing outboard. The single outboard facing cone cutter provides additional cutting elements for cutting a core. The single outboard facing cone cutter also creates an unbalanced loading condition on the core bit causing the bit to drill smoother than conventional reversed cone core bits.

9 Claims, 3 Drawing Sheets

ROLLER CONE CORE BIT

BACKGROUND OF THE INVENTION

This invention relates to an improved roller cone core bit used to cut a core of a subterranian formation. More particularly, the improved roller cone core drill bit includes a plurality of cone cutters facing inboard and a single cone cutter facing outboard.

Conventional roller cone core bits include a plurality of inboard facing cone cutters. The cone cutters are frusto-conical in shape with rows of cutting elements, such as milled steel teeth or wear resistant tungsten carbide inserts. During drilling operations, the cone cutters cut a cylindrical core in addition to cutting the bottom and outer diameter of the borehole. With insert roller cone core bits, the nose inserts, located about the apex of the cone cutter, cut the cylindrical core. There are fewer inserts in the nose area than on the remainder of the core cutter. Thus, relatively few inserts actually cut the core. The remaining inserts cut the bottom of the borehole. When the bit is rotated, the nose inserts move slowly relative to the formation in comparison with the outer row of inserts that cut the gage diameter of the borehole. The slower moving nose inserts tend to drag across the formation which leads to accelerated wear on the inserts, especially in abrasive formations. Increased wear on the nose inserts leads to nose area failure which is one of the most common modes of failure in rotary cone core bits.

To overcome the problem of nose area failures, practitioners in the coring industry increased the number of inserts cutting the core by reversing a plurality of cone cutters to face outboard. The outboard facing cone cutters, or reversed cones, had the rows with the most inserts cutting the core. The prior art reversed cone core bits were symmetrically balanced and did not impart a continuous lateral outward load on the borehole while coring. Conventional reverse cone core bits were symmetrically arranged with, for example, four cone cutters facing inboard and two cone cutters opposite each other facing outboard; with three cone cutters facing inboard alternating with three cone cutters facing outboard; or with two cone cutters facing inboard alternating with two cone cutters facing outboard. Due to the symmetrical arrangement, there was negligible continuous lateral loading against the borehole while coring.

Conventional reversed cone core bits reduced the number of nose area failures by providing more inserts for cutting the core. However, reversing 2 of 4 cones or even 2 of 6 cones places a higher percentage of the available inserts than is necessary to the inner area of the borehole. While this improves the life of the bit adjacent the core, it diminishes the life of the bit at the outer areas by removing too many inserts from the zone where the largest volume of rock is being removed. Accordingly, conventional reversed cone cutters have an inadequate percentage of inserts, or cutting elements, to cut the remainder of the borehole. The useful life of the conventional reversed cone core bits suffered because of the insufficient number of inserts for cutting the remainder of the borehole.

The present invention overcomes the problems associated with conventional roller cone core bits and conventional reversed cone core bits. The present invention includes a plurality of inboard facing cone cutters and a single outboard facing cone cutter. The single outboard facing cone cutter provides additional inserts for cutting the core, thereby reducing the potential for nose area failure of the core bit. At the same time, the present invention leaves more inserts for cutting the remainder of the hole than conventional reversed cone core bits. Unlike conventional reversed cone core bits, the bit of the present invention is not starved for cutters for cutting the remainder of the borehole.

In addition to the above mentioned benefits, the present invention creates an unbalanced load on the bit, with the net result being a continuous lateral load imparted on the borehole by the bit. This unbalanced loading is created by the asymmetrical arrangement of the plurality of the inboard facing cones and the single outboard facing cone. As a result of the unbalanced load, one side of the bit will always be forced against the borehole wall causing the bit to run smoother than conventional reversed cone core bits. The unbalanced loading reduces the natural whirling action of the bit causing it to drill much smoother. A smoother drilling core bit reduces the likelihood of breaking and jamming the core in the core barrel and thus increases the likelihood of recovering a longer core section. The reduction of the whirling action of the bit is also beneficial because the whirling action tends to reduce the diameter of the recovered core. Thus, the roller cone core bit of the present invention also increases an operator's ability to recover a full gage core. Reduction in whirling also contributes to more efficient cutting action and longer bit life. The energy which would normally fuel the whirling action is now available for drilling. Whiffing causes lateral shock loading on rock bit bearings and stresses the seals. It also causes shock loading on the inserts which can result in early failure due to breakage. The lateral motion caused by whirling also causes more wear on the inserts.

SUMMARY OF INVENTION

The present invention relates to an improved roller cone core bit. More particularly, the improved roller cone core bit includes a plurality of cone cutters facing inboard and a single cone cutter facing outboard. The outboard cone cutter provides additional cutting elements for cutting the core. The single outboard cone cutter also creates unbalanced loading on the cone cutters which causes the core bit to drill smoother than conventional reversed cone core bits. The smoother drilling roller cone core bit of the present invention increases the likelihood that a longer continuous core can be cut and recovered.

DESCRIPTION OF THE PREFERRED EMBODIMENTS

Figure 1:
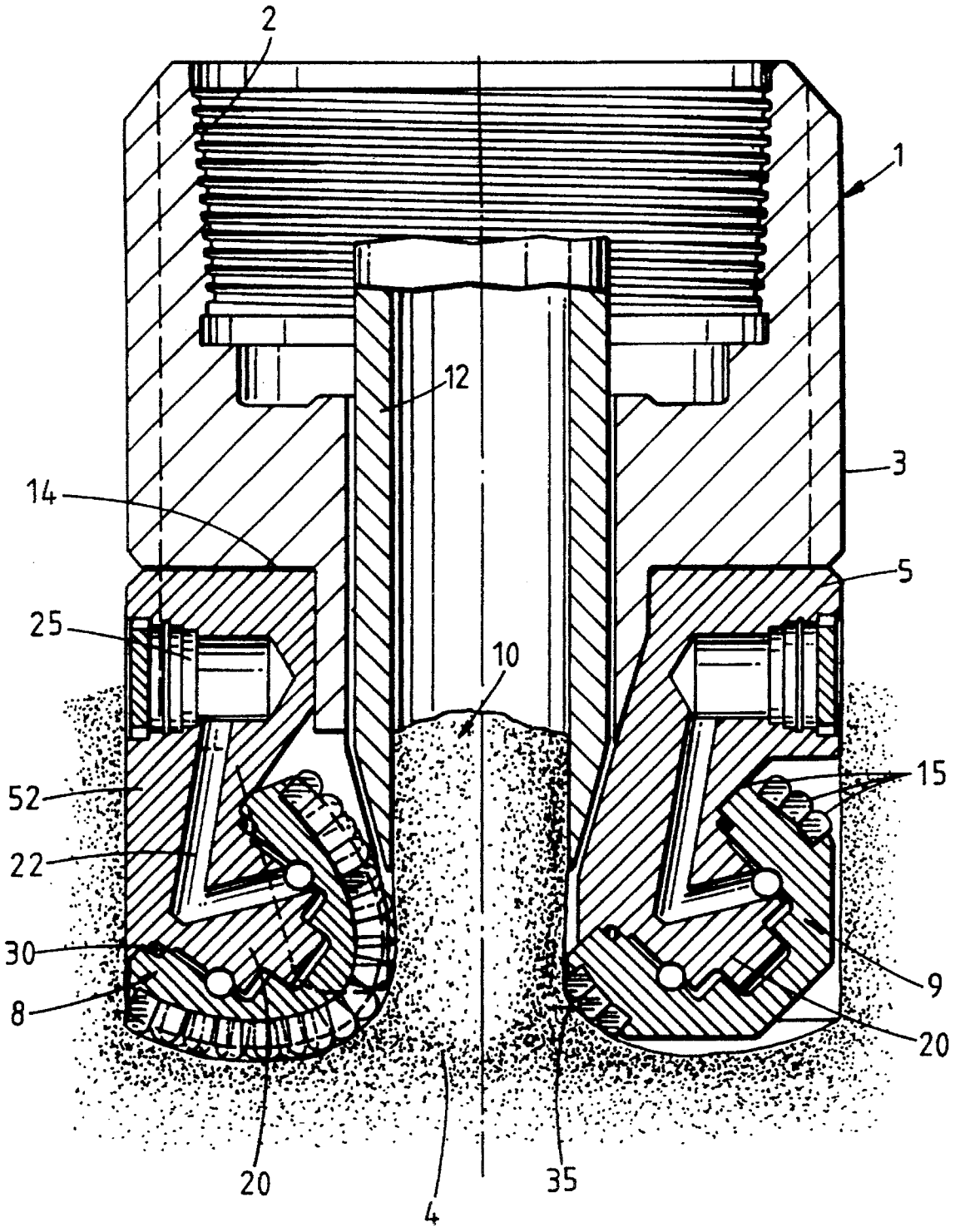
FIG. 1 is a side view of a preferred embodiment of the present invention.

Referring to FIG. 1, core bit 1 has an internally threaded box 2 on its upper end for securing the core bit to the core barrel and drill string. Core bit 1 has a plurality of journal segment arms 5 mounted on its lowermost end. A frusto-conical cone cutter is rotatably mounted and secured on a journal which extends downward from the bottom of each journal segment arm 5. The frusto-conical cone cutters drill a doughnut shaped hole in a subterranean formation 4, leaving a cylindrical plug or core 10 in the center. As drilling progresses, core 10 rises inside a hollow tube or inner core barrel (not shown) above the core bit 1 where it is captured and subsequently retrieved at the surface. Core catcher 12 helps guide the core into the hollow tube or inner core barrel above the bit while being configured to prevent the downward movement of the captured core so that the core may be recovered at the surface. The various configurations of core catcher 12, along with its use with the inner core barrel, are well known in the coring industry.

Figure 2:
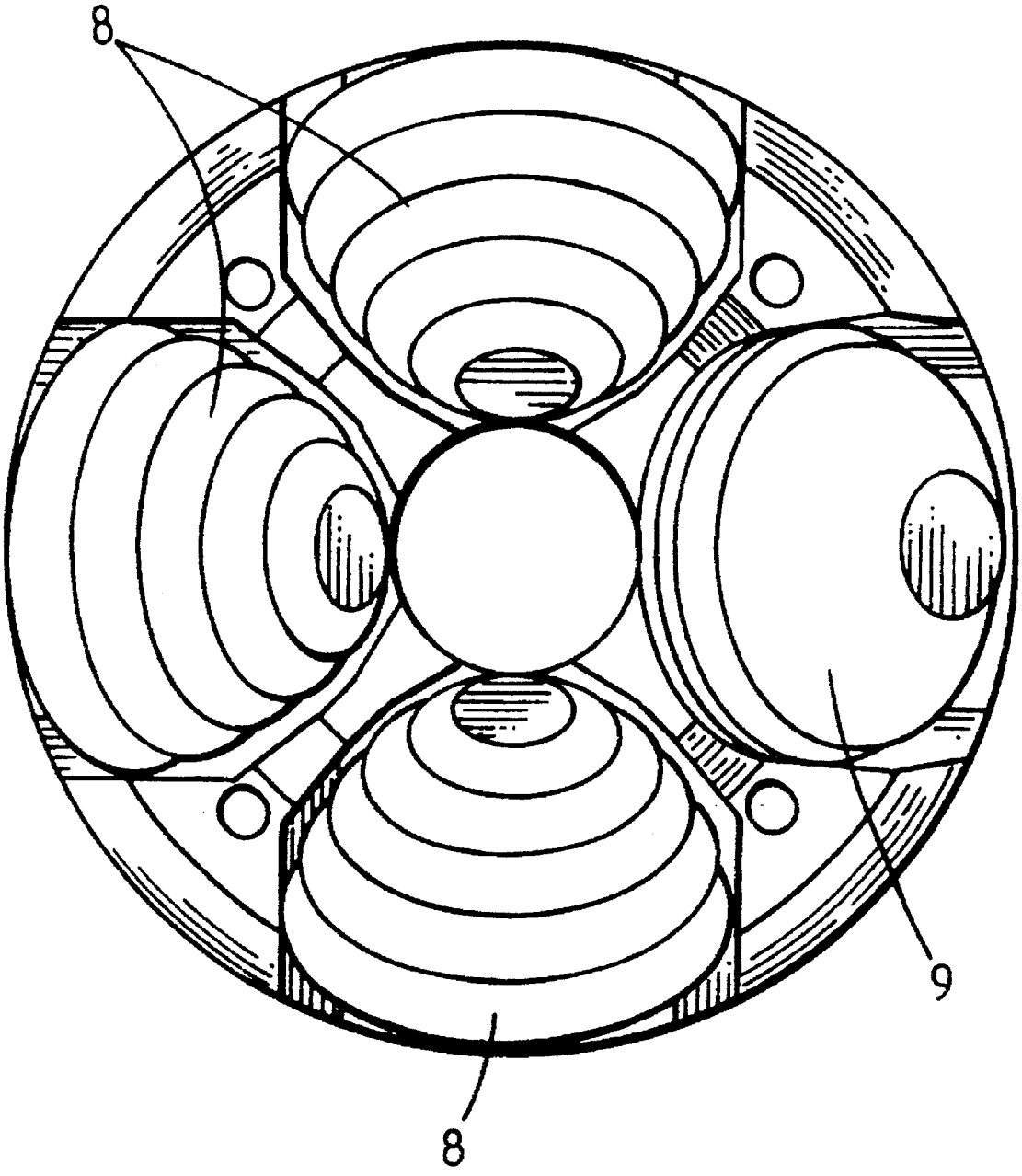
FIG. 2 is a top view of the roller cone core bit shown in FIG. 1.

The upper end of the journal segment arms 5 are securely affixed by welding or other appropriate means to journal segment pocket 14 at the lower end of a cylindrical bit body 3. Core bit 1, as shown in FIG. 1, includes a plurality of cone cutters that are rotatably mounted on journals 20 with sliding beating surfaces. This is meant to include journal bearings either with or without journal bushings. Journal bearings carry the load on surfaces which slide relatively to each other. Although not illustrated, the present invention may also be utilized with roller cone cutters mounted on sealed or unsealed roller bearings. As shown in FIG. 2, core bit 1 includes a plurality of inboard facing cone cutters 8 and a single outboard facing cone cutter 9. The cone cutters have rows of tungsten carbide inserts for cutting the borehole and core. The tungsten carbide inserts are press fitted into circumferential rows of receiving apertures in the cone surface. The number of inserts on each row will depend on the circumference of the row. In general, more inserts can be used on a given row as the circumference of the row increases. While the preferred embodiment shown in the accompanying drawings illustrate wear resistant inserts for the cutting elements of the bit, the present invention may also be used with roller cone cutters having rows of milled steel teeth.

Each journal segment arm 5 includes a passageway 22 for inserting retaining balls about journal 20. Passageway 22 also serves as a channel for supplying lubricant to the bearing surfaces. A lubricant reservoir 25 is also provided in each journal segment arm 5 for maintaining a sufficient quantity of lubricant for the bearing surfaces. Details of reservoir systems are commonly understood in the art and are not illustrated in this sketch. A cone/journal seal 30 protects the bearing structure from drill cuttings and other foreign debris. The cone/journal seal 30 may be an elastomeric packing ring, such as an o-ring seal, or other suitable structure.

Figure 3:
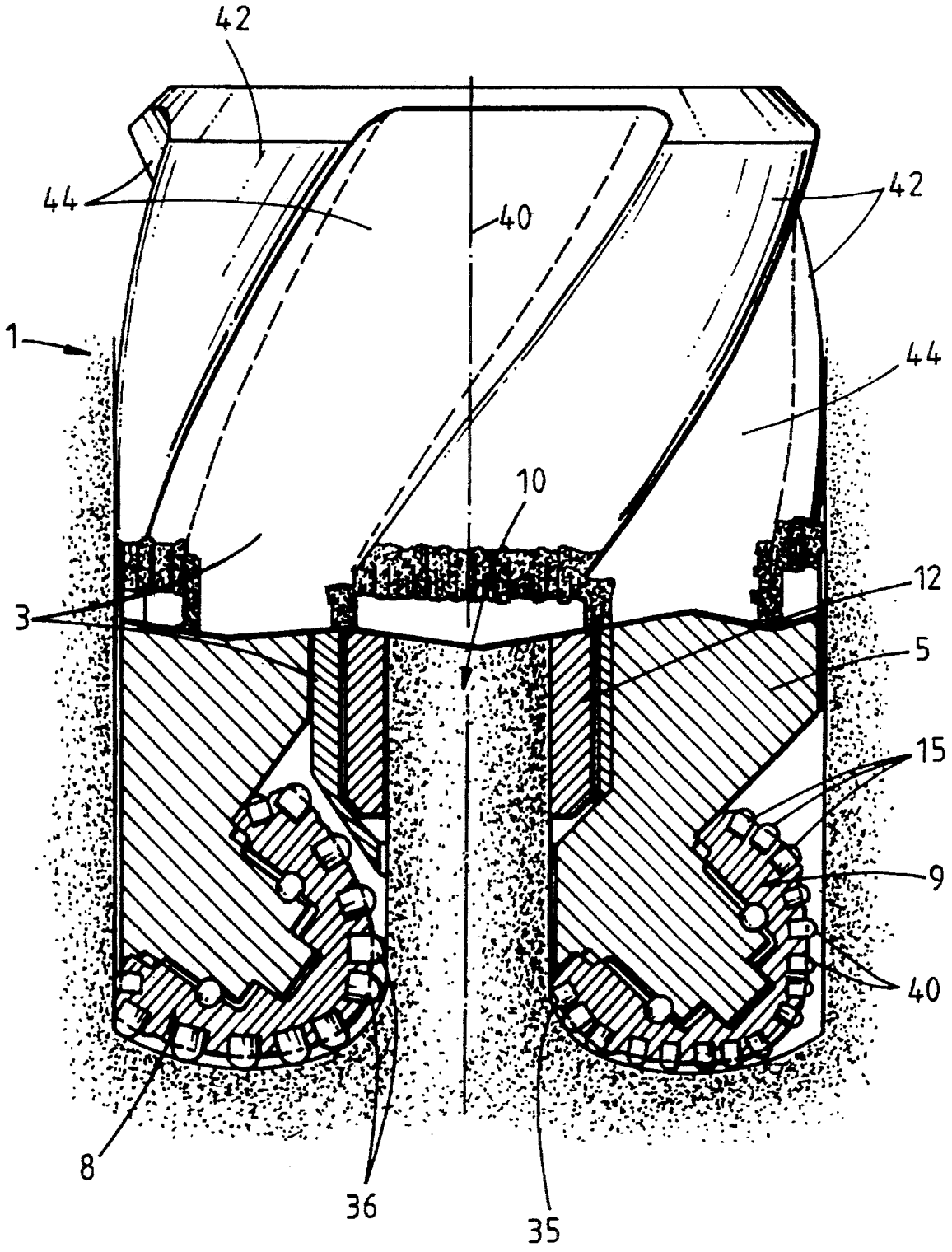
FIG. 3 is a side view of another embodiment of the present invention having stabilizer blades spirally oriented about the longitudinal axis of the core bit.

The embodiments shown in FIGS. 1 and 3 include three inner rows of active inserts, collectively illustrated as 15, on outboard facing cone 9 for cutting core 10. The innermost row 35, referred to as the core heel row, includes the core heel inserts that cut core 10 to gage diameter. Inboard facing cones 8 have nose area inserts 36 that also cut core 10 to gage diameter. However, since more cutters can be arranged on core heel row 35 than on the nose area of the inboard facing cones, core bit 1 is less likely to fail from nose area failure than conventional roller cone core bits. By way of example, cone 9 may include approximately 70 active inserts in rows 15 for cutting a core, while the inboard facing cones may have only 5 or 6 nose area inserts for cutting the core. There are enough active inserts on the reversed cone to continue cutting the core even after the nose area inserts on the inboard facing cones are worn away. The number of inserts described in the above example is for illustrative purposes only and is not meant to limit the present invention in any way.

The primary purpose of reversed cone 9 is to provide additional cutters for cutting core 10. Cone 9, as illustrated in FIG. 3, also includes additional rows of smaller inactive inserts 40. These inactive inserts serve primarily to protect the integrity of the apex of cone 9 from wear. Inserts 40, as illustrated, are not designed to cut virgin formation and hence are referred to as inactive inserts. Other embodiments of the invention, however, may have active cutters for cutting virgin formation on all rows of cone 9.

Superimposed on an inboard facing cone 8 in FIG. 1 are the wear resistant inserts for the other inboard facing cones. The superimposed inserts on cone 8 in FIG. 1 illustrates the number of rows of inserts on the inboard facing cones that cut the bottom of the borehole. As shown in FIG. 1, there is a sufficient number of inserts on the inboard facing cones to adequately cut the remainder of the borehole. Unlike conventional reversed cone core bits, the remainder of the borehole is not starved for cutters. Accordingly, the core bit of the present invention will last longer than conventional reversed cone core bits.

The single outboard facing cone cutter 9 causes an unbalanced loading condition on the core bit 1. As a result, a continuous lateral load is imparted on one side of the borehole by the bit. The unbalanced loading causes the core bit to drill smoother than prior art roller cone core bits. Conventional roller cone core bits tend to whirl about the longitudinal axis of the borehole. This whirling action is detrimental for several reasons. The whirling action tends to reduce the diameter of the core. The whirling action also increases the likelihood of the core breaking and jamming inside the core barrel, thus reducing the amount of recoverable core. The unbalanced loading created by the single reversed cone of the present invention reduces the whirling action thus increasing the likelihood of recovering longer cores of gage diameter.

Due to the side loading of the bit, core bit 1 requires stabilization within the borehole. Preferably, core bit 1 includes stabilizer blades that are spirally oriented about the longitudinal axis 40 of bit body 3. Preferably, the spirally oriented stabilizer blades have up to 360° of wall contact with a full gage borehole. Spirally oriented stabilizer blades for roller cone core bits are disclosed in U.S. Patent application Ser. No. 08/007,257, incorporated herein by reference. FIG. 3 illustrates the core bit of the present invention with stabilizer blades 42 spirally oriented about the longitudinal axis of bit body 3. The stabilizer blades 42 are fixedly attached to the circumference of bit body 3 and extend substantially from the top of core bit 1 to the top of the journal segment arms 5. The spiral stabilizer blades 42 extend radially from the core bit. Stabilizer blades 42 as shown in FIG. 3, radially extend to substantially the gage diameter of the core bit. Between the stabilizer blades are junk slots 44 which provide passageways for cuttings removal by the drilling fluid. Alternatively, a stabilizer may be mounted on the outer core barrel (not shown) near the core bit.

It will be understood by those skilled in the art that some variations and modifications can be made without departing from the spirit and scope of the invention as defined herein and in the appended claims.

By way of example, a variation of this bit is also being used to open a small cored hole to a larger diameter borehole. This bit requires a large hole in its center through which the smaller coring bit and coring string can pass. Thus, instead of being connected to a conventional core barrel assembly, this embodiment has a sufficiently large center hole extending longitudinally through the bit body for passage of a separate coring assembly through the center of the bit. Once the smaller coring assembly has cut a core and been retrieved, the bit can be rotated as a hole opener to open the cored hole to a larger diameter hole. By way of example, a 12 inch diameter bit having a plurality of inboard facing cone cutters and a single outboard facing cone cutter is used as a hole opener for opening a 4 inch cored hole to a substantially 12 inch diameter borehole. The reversed cone provides smoother operation during normal drilling and provides additional cutting inserts in instances when the cored hole deviates from the path of the 12 inch bit.

I claim:

1. A roller cone core drill bit comprising:

a cylindrical bit body having a means for connecting the roller cone core drill bit to a drillstring on one end and a plurality of journal segment arms on another end;

a plurality of inboard facing cone cutters, the inboard facing cone cutters being rotatably mounted on journals that extend downward from the journal segment arms; and a single outboard facing cone cutter rotatably mounted on a journal that extends downward from a journal segment arm, wherein the single outboard facing cone cutter includes a core heel row of cutting elements for cutting a core.

2. The roller cone core drill bit of claim 1 wherein the cutting elements of the core heel row comprise tungsten carbide inserts.

3. The roller cone core drill of claim 1 wherein the cutting elements of the core heel row comprise milled steel teeth.

4. The roller cone core drill bit of claim 1 wherein the roller cone core drill bit imparts a continuous lateral load on a borehole.

5. The roller cone core drill bit of claim 1 further comprising a plurality of stabilizer blades fixedly attached to a circumference of the cylindrical bit body.

6. The roller cone core drill bit of claim 5 wherein the stabilizer blades are spirally oriented about the longitudinal axis of the cylindrical bit body.

7. The roller cone core drill bit of claim 5 wherein the stabilizer blades extend to substantially the gage diameter of the roller cone core drill bit.

8. The roller cone core drill bit of claim 6 wherein the stabilizer blades provide substantially 360° of wail contact with a full gage borehole.

9. A roller cone hole opening drill bit comprising:

a cylindrical bit body having a means for connecting the roller cone hole opening drill bit to a drillstring on one end and a plurality of journal segment arms on another end;

a plurality of inboard facing cone cutters, the inboard facing cone cutters being rotatably mounted on journals that extend downward from the journal segment arms; a single outboard facing cone cutter rotatably mounted on a journal that extends downward from a journal segment arm; and a hole extending longitudinally through a center of the cylindrical bit body, the hole having a diameter of sufficient size for passage therethrough of a separate, smaller coring assembly.

* * * * *

UNITED STATES PATENT AND TRADEMARK OFFICE

CERTIFICATE OF CORRECTION

PATENT NO. : 5,454,437

DATED : October 3, 1995

INVENTOR(S) : Roy D. Estes

It is certified that error appears in the above-indentified patent and that said Letters Patent is hereby corrected as shown below:

Column 6, line 13, delete "wail" and insert therefor --wall--;

Column 6, line 23 should start a new subparagraph.

Signed and Sealed this

Nineteenth Day of December, 1995

*Attest:*

*Attesting Officer*

BRUCE LEHMAN

*Commissioner of Patents and Trademarks*